US005954433A

United States Patent [19]

Yeager

[11] Patent Number: 5,954,433

[45] Date of Patent: Sep. 21, 1999

[54] RECLOSABLE BAG WITH IMPROVED OPENING FEATURE

[75] Inventor: James W. Yeager, Mobile, Ala.

[73] Assignee: Innoflex Incorporated, Mobile, Ala.

[21] Appl. No.: 08/986,138

[22] Filed: Dec. 5, 1997

[51] Int. Cl.[6] ..... B65D 33/04

[52] U.S. Cl. ..... 383/61; 383/63; 383/66; 383/207; 383/210

[58] Field of Search ..... 383/61, 63, 66, 383/210, 211, 207; 24/587

[56] References Cited

U.S. PATENT DOCUMENTS

| | | | |
|---|---|---|---|
| 2,428,745 | 10/1947 | Stillson et al. . | |
| 2,666,709 | 1/1954 | Ravenwald et al. . | |
| 2,683,694 | 8/1954 | Hoffmann et al. . | |
| 2,704,746 | 3/1955 | Chenicek . | |
| 2,978,769 | 4/1961 | Harrah . | |
| 3,172,443 | 3/1965 | Ausnit . | |
| 3,181,583 | 5/1965 | Lingenfelter . | |
| 3,266,965 | 8/1966 | Spees . | |
| 3,426,959 | 2/1969 | Lemelson . | |
| 3,532,571 | 10/1970 | Ausnit . | |
| 3,608,439 | 9/1971 | Ausnit . | |
| 3,827,472 | 8/1974 | Uramoto . | |
| 3,948,705 | 4/1976 | Ausnit . | |
| 3,984,600 | 10/1976 | Kawase et al. | 24/399 X |
| 4,094,729 | 6/1978 | Boccia . | |
| 4,246,288 | 1/1981 | Sanborn, Jr. . | |
| 4,335,817 | 6/1982 | Bahr . | |
| 4,570,820 | 2/1986 | Murphy . | |
| 4,617,683 | 10/1986 | Christoff . | |
| 4,655,862 | 4/1987 | Christoff et al. . | |
| 4,782,951 | 11/1988 | Griesbach et al. . | |
| 4,894,975 | 1/1990 | Ausnit . | |
| 5,022,530 | 6/1991 | Zieke . | |
| 5,024,537 | 6/1991 | Tilman . | |
| 5,026,563 | 6/1991 | Van Erden et al. . | |
| 5,050,736 | 9/1991 | Griesbach et al. . | |
| 5,063,069 | 11/1991 | Van Erden et al. . | |
| 5,096,516 | 3/1992 | McDonald et al. . | |
| 5,116,140 | 5/1992 | Hirashima . | |
| 5,157,811 | 10/1992 | Bodolay . | |
| 5,186,543 | 2/1993 | Cochran . | |
| 5,461,845 | 10/1995 | Yeager . | |
| 5,525,363 | 6/1996 | Herber et al. . | |
| 5,601,368 | 2/1997 | Bodolay et al. . | |
| 5,672,009 | 9/1997 | Malin . | |
| 5,806,984 | 9/1998 | Yeager | 383/61 X |

FOREIGN PATENT DOCUMENTS

| | | |
|---|---|---|
| 0 528 721 A2 | 2/1993 | European Pat. Off. . |

*Primary Examiner*—Jes F. Pascua
*Attorney, Agent, or Firm*—Rockey, Milnamow & Katz, Ltd.

[57] ABSTRACT

A package in the form of a reclosable bag includes a bag body including front and back walls, and a profile strip fastener assembly sealingly mounted on the inside surface of the front wall. The profile strip fastener assembly includes a pair of releasably interlocking profile strips. The bag body preferably includes a frangible joint substantially aligned with the fastener assembly for gaining access to the assembly, with the frangible joint desirably providing tamper-evidence of opening of the package. The profile strips are sealed to the front wall of the bag body with a continuous oval shaped seal around the frangible joint. A peelable seal is arranged between the profile strips and the bag body, over the frangible joint to substantially hermetically seal the frangible joint. Additionally, an antioxidant constituent can be blended into the material forming the profile strips to inhibit oxygen transmission through the profile strips.

13 Claims, 4 Drawing Sheets

RECLOSABLE BAG WITH IMPROVED OPENING FEATURE

TECHNICAL FIELD

The present invention relates generally to flexible bag-like packages, and more particularly to a flexible reclosable bag including an improved sealing arrangement for an openable profile strip fastener assembly mounted on a front wall of the body of the bag. The sealing arrangement is particularly related to a package having a line of perforations through the front wall forming a frangible joint in registry with the openable profile strip fastener and a peelable seal arranged between the frangible joint and the openable profile strip fastener.

BACKGROUND OF THE INVENTION

Reclosable packaging is particularly suited for packaging of food products when it is desired to repeatedly remove relatively small quantities of the food product. Such food products include cereals, rice, candies, and the like, and may also include meat food products, such as chicken, frankfurters, sliced meats, etc. While the use of reclosable flexible bags having twist-tie wire fasteners or plastic clasps has long been known, recent advents in reclosable packaging have included configuring packages to have integral zipper-type fastener assemblies, including interlocking profile strips. In such arrangements, the package is typically opened by cutting or tearing a portion of the package to gain access to the fastener assembly, with opening and closing of the profile strips of the fastener assembly thereafter permitting the package to be selectively opened and closed.

Some food products, however, are preferably stored in a sealed fashion, preventing the ingress of oxygen into the package. This prevents food spoilage and increases the shelf life of the product. It would be desirable to provide an easily opening portion of the package to gain access to the profile strips which also maintains the sealed integrity of the package.

It is known that antioxidants or antioxidizing agents can be added to the preparation of food products (cereals, snack-foods, or the like) and some non-food products (cosmetics, perfumes, or the like) to protect the points of unsaturation from oxidizing and peroxide formation and therefore extending their shelf life. As taught in U.S. Pat. Nos. 2,428,745; 2,666,709; 2,683,694; and 2,704,746 naturally occurring antioxidants such as BHT (butylated hydroxy toluene and known chemically as 2,6-di-tertiary butyl-p-cresol or 2,6-di-tertiary butyl-4-methyl-phenol), BHA (butylated hydroxy anisole and known chemically as a mixture of 3-tertiary butyl-4-hydroxyanisole and 2-tertiary butyl-4-hydroxyanisole), TBHQ (tertiary butyl hydroquinone and known chemically as 2-(1,1-dimethylethy)-1,4-benzenediol), and PG (propyl gallate or known chemically as n-propyl-3,4,5, tri-hydroxybenzoate) or combinations thereof may be used in an amount of about 2 to 50 parts per million, based on the weight of the product, to protect against rancidity of the native lipids.

It is also known in the art of packaging that antioxidants such as BHT, BHA, TBHQ, and PG can be used with packaging substrates so as to produce packages that have the ability to prolong the shelf life of the stored product by minimizing the effects of oxidation. Antioxidants have been blended with coatings or adhesives for use with packaging substrates such as paperboard, corrugated paper, waxed paper, and plastic films. In actual practice the antioxidant migrates to the surface of the packaging substrate where it is released into the environment surrounding the package. This phenomena results in an atmosphere containing oxygen scavenger sites surrounding the package. The result is that the package containing the oxygen scavengers possesses the ability to neutralize oxygen molecules that come in direct contact with the substrate as well as ones that come within the immediate surroundings.

It would be desirable to produce a bag or package closure having a profile strip fastener and which included an anti-oxidant feature for scavenging oxygen before the oxygen entered the package through the profile strip fastener.

SUMMARY OF THE INVENTION

A package in the form of a reclosable bag embodying the principles of the present invention includes a profile strip fastener assembly which is joined to a front wall of a bag body. The profile strip fastener includes an openable mouth formed by interlocking profile strips, allowing access to the contents of the bag. The front wall includes a joint defined by a pattern of perforations, the joint in registry with the openable mouth of the profile strip fastener assembly, and a peelable seal arranged between the front wall and the profile strip fastener assembly along, and covering, the perforations. Notably, the peelable seal, in addition to the closure formed by the interlocking profile strips of the assembly, enhances the sealing integrity of the fastener assembly during package formation, filling, and subsequent storage and use. Oxygen barrier packaging can be produced in accordance with the principles disclosed herein by the provision of profile strip assemblies and bag film materials exhibiting oxygen-barrier properties.

In accordance with the illustrated embodiment, the present reclosable bag includes a bag body formed from a rectangular sheet of film material, such as plastic film material or the like. The bag body has a top end, a bottom end, a front wall, and a back wall, wherein the front wall is joined to the back wall by upper and lower seams respectively provided at the top and bottom ends of the bag body. The bag and profile strip assembly are configured to be compatible with a conventional form, fill and seal machine.

A reclosable profile strip fastener assembly is joined to the front wall of the bag body and comprises first and second interlocking profile strips which respectively extend along the length of the fastener assembly. The profile strips are configured for releasable interlocking engagement with each other by the provision of at least one elongated protuberance on one of the profile strips, and at least one groove defined by the other of the profile strips for respectively releasably receiving the protuberance.

The fastener assembly is specifically configured for independent securement to the inside surface of the front wall of the bag body, and to this end, the first profile strip of the assembly includes a first body flange portion joined to an inside surface of the front wall. Similarly, the second profile strip includes a second body flange portion joined to the inside surface of the front wall of the bag body.

In the preferred embodiment, the front wall of the bag body includes an elongated, frangibly openable joint which is substantially aligned with the fastener assembly. This openable joint provides access to the openable mouth formed by the interlocking profile strips of the fastener assembly after the joint is opened on the front wall of the bag body. The provision of this openable joint in the bag body desirably provides tamper-evidence of opening of the bag. The joint can be a substantially linear arrangement of perforations or a rectangular or oval pattern of perforations which defines a removable or partially removable panel. The first and second body flange portions are sealed to the front wall with a continuous perimeter seal which surrounds the joint. The second profile strip body flange portion can also be sealed along its bottom edge region to the bag front wall.

In order to enhance the sealing integrity of the fastener assembly, one or both of the profile strips are sealed to the front wall of the bag over the perforations by the peelable seal. The peelable seal closes the perforations. In this manner, the peelable seal must be opened to provide access to the openable mouth between the first and second profile strips to release the interlocking engagement of the profile strips.

An area of the bag front wall that surrounds the line of perforations and that is inside the perimeter heat seal is laminated by the peelable seal to the body flange portion of the first profile strip and/or the second body flange portion of the second profile strip. The arrangement of the peelable seal acts to minimize the oxygen transmission into the bag through the perforations and through a perforated thumb tab feature which is peelable for providing a thumb gripping surface for opening the bag. The area for oxygen to enter the bag at the joint is thus effectively limited to only the small perforations. Oxygen thus can only enter the bag through the microstructure of the material of the body flange portion opposing the perforations, and oxygen accumulated within the small unsealed portion corresponding to the thumb tab feature. The peelable seal layer can be provided on either the body flange portions or the bag front wall film surface, or both.

A secondary peelable seal can also be used between the body flange portions. Such a secondary peelable seal would serve as additional assurance that the fastener sealing arrangement is air tight.

The invention thus contemplates a configuration that, when used with a reclosable bag of the type having both of the profile strips of a flanged reclosable fastener strip attached to a single bag wall and using a pattern of perforations as the means of accessing the fastener, will improve the barrier characteristics of the bag. The location of the peelable seal will allow the barrier properties of the bag to be maintained when a bag is used for certain barrier applications in the medium to high barrier range, such as when nylon is used as the barrier layer for bags used for storing cereal or certain snack-foods, or the like.

As another aspect of the invention, a reclosable fastener assembly with at least two interlocking profile strips, is produced from a polymeric material which includes the addition of an antioxidant for the purpose of acting as an oxygen scavenger for packaging products that are susceptible to oxidation.

In some packages, the fastener assembly, more particularly the body flange portion(s), may be exposed to oxygen transmission and therefore the fastener of my invention has the additional advantage of being able to react with the oxygen that attempts to pass through the openable mouth between the profile strips, or directly through the fastener's microstructure.

An exemplary embodiment of a package structure using an antioxidant according to the present invention can also be one such as disclosed in U.S. Pat. No. 5,461,845, where a line of perforations are utilized as the means for accessing the fastener which exposes the fastener to the oxygen of the air surrounding the package. The addition of an antioxidant to the fastener profile strip of the structure disclosed herein, or in combination with the package type of U.S. Pat. No. 5,461,845, results in a low cost form, fill and seal (FFS) package with an easy opening tamper evident feature that can be used to package oxygen sensitive products.

The fastener of the present invention would include enough food-grade antioxidant so as to create an environment including oxygen scavengers in the space around the fastener, especially in the clearance space between the interlocking strips so as to neutralize the oxygen in these areas before entering the confines of the package. The antioxidant can be blended into the interlocking bodies and/or the body flange portions of the profile strips. The antioxidant is preferably blended into the interlocking bodies so as to be in close confines with the joint which separates the profile strips. The antioxidant can be blended into the body flange portion as well. The antioxidant can be blended into one or both of the profile strips.

This is a significant advance in the art of packaging since reclosable interlocking fastener strips are normally not air tight and therefore allow significant amounts of oxygen to enter the package through clearance between the interlocking strips. This clearance is required so that the strips can be separated with sufficient ease by the user.

Other features and advantages of the present invention will become readily apparent from the following detailed description, the accompanying drawings, and the appended claim.

DETAILED DESCRIPTION

Figure 1:
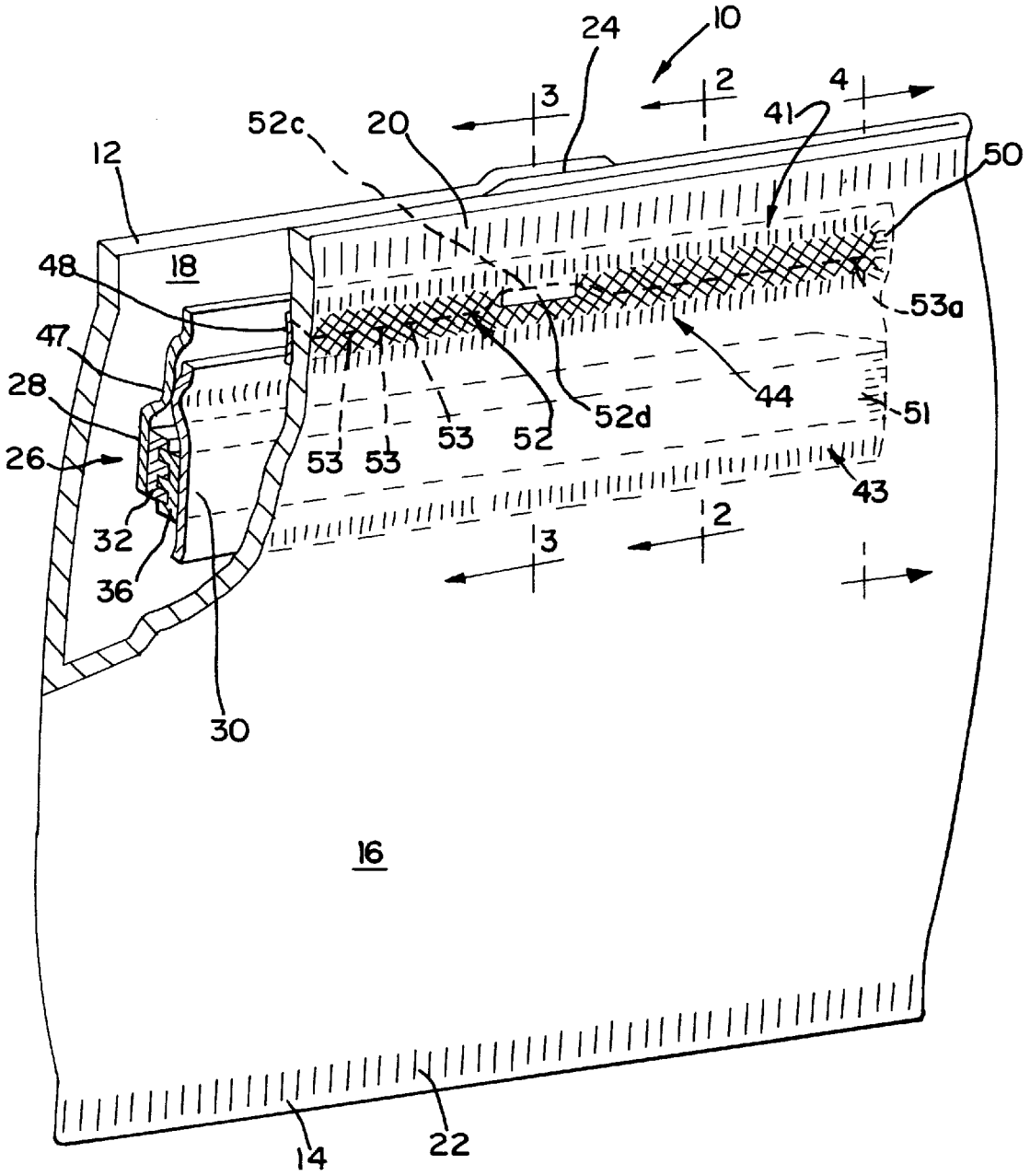
FIG. 1 is a perspective partially cut-away view of a package in the form of a reclosable bag embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiments illustrated.

With reference now to the drawings, a package in the form of a reclosable bag 10 is illustrated which embodies the principles of the present invention. It is contemplated that the bag 10 be formed from suitable plastic film materials or the like, but it is within the purview of the present invention to form the bag from paper or paper-like materials. As will hereinafter be described, bag 10 is specifically configured in a manner which facilitates formation of the bag from a substantially continuous web of film material, to which fastener assemblies have been previously applied, for use in a so-called form, fill, and seal apparatus for packaging of food products, or non-food products. For example, the present package can be configured for packaging of non-food items such as hardware articles or the like, wherein repeated opening and closing of the package is desired.

The reclosable bag 10 is formed from a generally rectangular sheet of film material, and includes a top end generally designated 12, a bottom end generally designated 14, and front and back walls 16 and 18. The front and back walls are joined to each other by upper and lower seams 20, 22 (shown schematically as tracks), respectively provided at top and bottom ends 12 and 14 of the bag. Lateral edges of the rectangular sheet of film material from which the bag body is formed are joined to each other along a back seam 24 extending vertically along back wall 18. The seams 20, 22, and 24 can be formed adhesively, or by heat-sealing as is known in the art. As will be appreciated, a bag configured in accordance with the present invention can be formed from two rectangular sheets of bag material joined at their peripheral regions to form a package, with the fastener assembly having a length corresponding to the width of the sheet of bag material to which the fastener assembly is joined.

Reclosable bag 10 includes profile strip fastener assembly 26 which is sealingly mounted on the inside surface of front wall 16. In order to permit use of the present bag with conventional packaging equipment, fastener assembly 26 has a length no more than one-half the width of the rectangular sheet of film material from which the bag body is formed. In practice, a substantially continuous sheet of film material is provided with a plurality of the fastener assemblies 26 mounted thereon at spaced locations, which spacing corresponds to the length dimension of the bags ultimately to be formed. For use, this web of film material (with the fastener assemblies mounted thereon) is supplied to a form, fill, and seal apparatus which operates to form a series of the bags 10, in end-to-end relationship, by formation of back seam 24, bottom seam 22, and top seam 20, as food product is supplied to the individual bags being formed. After formation and filling, the individual bags are ordinarily separated from each other for packaging and shipment, as may be required.

With particular reference to FIGS. 1 through 4 the fastener assembly 26 includes a first elongated profile strip 28, and a second elongated profile strip 30 which are configured for releasable interlocking engagement with each other. While the specific configuration of the profile strips can be varied while keeping with the principles disclosed herein, it is contemplated that one of the profile strips (first strip 28 in the illustrated embodiment) includes a body 32 which defines at least one elongated groove, such as two grooves 34*a*, 34*b*, while the other profile strip (second strip 30) includes a body 36 which defines at least one protuberance, such as two protuberances 38*a*, 38*b*, configured for respective interlocking engagement with the grooves 34*a*, 34*b*. As will be recognized by those familiar with the art, the number of grooves and protuberances, and their respective disposition on the first and second profile strips, can be varied while keeping with the principles disclosed herein.

The fastener assembly 26 is sealingly mounted on the inside surface of the front wall 16 of the body of the reclosable bag 10, and to this end, each of the profile strips 28, 30, includes an elongated flange portion joined to the inside surface of the front wall. Specifically, first profile strip 28 includes a first body flange portion 40 which is joined to the inside surface of front wall 16 by elongated seal region 41 (shown schematically as tracks). Similarly, second profile strip 30 includes a second body flange portion 42 (including upper and lower flange regions which respectively extend upwardly and downwardly from the body 36) which is joined to the inside surface of front wall 16 by lower elongated seal region 43 (shown schematically as tracks), and upper elongated seal region 44 (shown schematically as tracks). Elongated seal regions 41, 44 may be arranged in the form of an continuous oval seal including end seal regions 50 (shown schematically as tracks) described below. It is within the purview of the present invention that seal regions 41, 43, 44, 50 may be formed with the use of suitable adhesive, but are preferably provided by heat-sealing (sometimes referred to as "lock-up" or "destruct" sealing). The seals 41, 43, 44, 50 are preferably continuous for strength and for sealing of the contents of the bags, but discontinuous seals may be suitable for some applications.

The flange portions of the first and second profile strips 28, 30 may be unitary with the respective body of the profile strip by formation of the flange portion from the same piece of material as the respective body. As disclosed herein, it is within the purview of the present invention that at least one of the flange portions of the profile strips be formed from material which differs from that from which the respective body of the profile strip is formed. The configuration of the present package can be desirable for use with certain perishable products that must be packaged in a manner which limits the amount of oxygen to which the products are exposed. For packaging of such products, the bodies 32, 36 of the first and second profile strips can be separately manufactured, and the flange portions 40, 42, thereafter respectively attached to the bodies. The bodies of the profile strips are normally produced from low pressure polyethylene due to the close tolerances required for the desired interlocking relationship of the components, and for ease of manufacturing. In contrast, the flange portions of the profile strips can be formed from material which is substantially different from polyethylene for relatively low oxygen transmission, such as materials including nylon, EVOH (ethylene vinyl alcohol), or combinations thereof, or the like.

Figure 2:
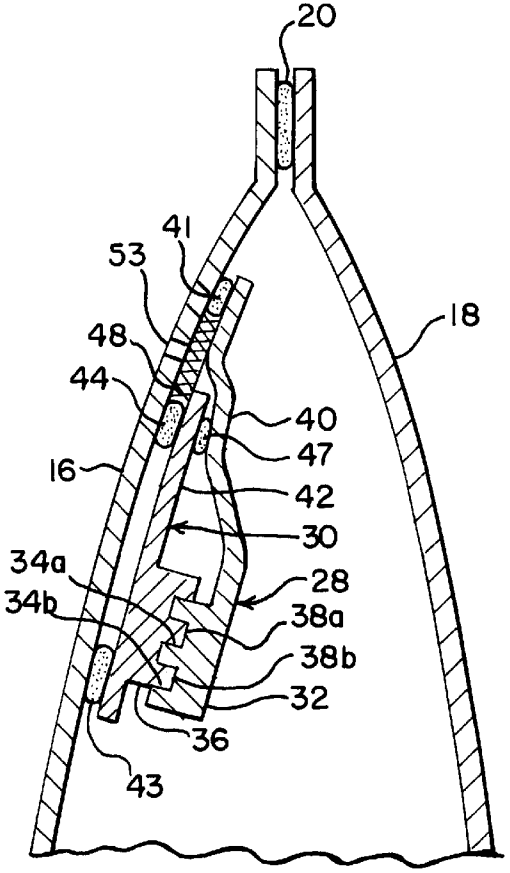
FIG. 2 is a fragmentary cross-sectional view taken along line 2—2 of FIG. 1.

As will be observed in FIG. 2, it is presently preferred that the body flange portion 40 of first profile strip 28 be positioned in substantially flush and coextensive relationship with that surface of the body 32 which defines the grooves 34*a*, 34*b*.

Figure 4:
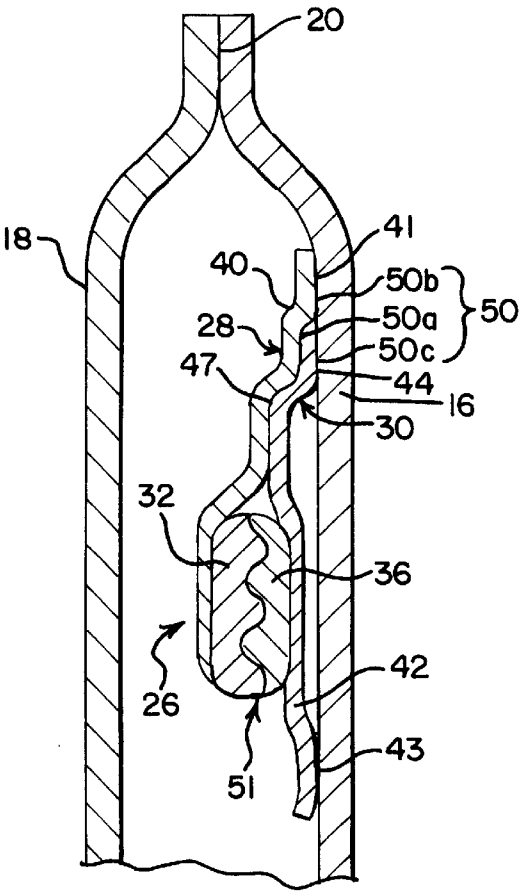
FIG. 4 is a fragmentary cross-sectional view taken along lines 4—4 of FIG. 1.
Figure 3:
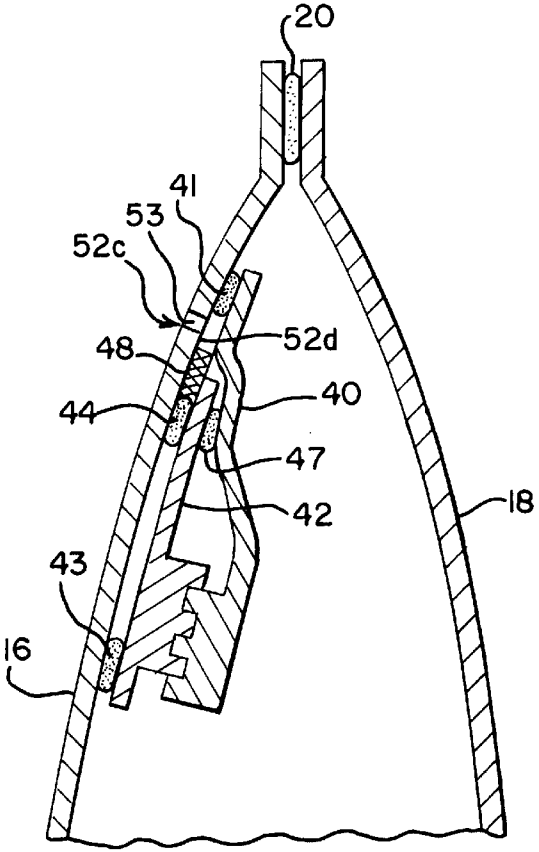
FIG. 3 is a fragmentary cross-sectional view taken along lines 3—3 of FIG. 1.

As illustrated in FIGS. 1 and 4, the opposite ends of the profile strips are sealed to each other (at end regions 51) to facilitate handling of the strips prior to securement to the associated film material of the bag body. In this regard, the lateral opposite ends of the fastener assembly, the fastener bodies 32, 36 are flattened and sealed together to prevent slippage of the profile strips 26, 28, thus avoiding any potential misalignment when reclosing the fastener assembly.

The nature of the profile strips 28, 30 is such that the interlocking portions of the strips can be configured to provide desirably high load-carrying characteristics, while at the same time still being readily manually detached from each other. The fastener assembly embodying the principles of the present invention can include a secondary, peelable seal 47 which detachably joins the profile strips to each other, apart from the releasable engagement of protuberances 38*a*, 38*b* in the grooves 34*a*, 34*b*. The secondary, peelable seal 47 provides a hermetic seal between the two body flange portions 40, 42.

Peelable seals, such as seal 47, are configured to peel open easily using minimal opening forces by utilizing low sealing temperatures, reduced dwell times, and light sealing pressures. Peelable seals can be produced in accordance with U.S. Pat. No. 5,050,736 incorporated herein by reference. Peelable seals can also be produced by utilizing a single polymer or from a combination of polymers that molecularly produce low seal strengths. A peelable seal can also be formed by selectively treating one or both of the flange portions of the profile strips, or the front wall of the bag body at least in the region at which the peelable seal is to be formed (such as by the localized application or coating of adhesive or like material). A peelable seal can also be provided by a separate strip of peelable seal material arranged between the two layers to be peel sealed. The peelable seal strip can be coextruded with one of the two layers to be peel sealed, and thereafter heat activated to form the peelable seal.

As will be appreciated, the seal 47 preferably is configured to extend substantially the entire length of the fastener assembly 26, thus desirably acting to provide an additional seal for the contents of the bag 10 in addition to the seal provided by interlocked portions 34*a*, 34*b*, 38*a*, 38*b* of the profile strips 28, 30. Further sealing of the contents of the bag against air and moisture transmission is preferably effected by the provision of end seals 50 at respective opposite lateral ends of the fastener assembly 26.

End seals 50 desirably act to sealingly join respective upper portions of lateral opposite ends of body flanges 40, 42 of the profile strips 28, 30 to each other at interface 50*a*. As will be recognized, the end seals 50 can be formed to also seal portions of the opposite lateral ends of the body flange portion 40 to the inside surface of the front wall 16 at interface 50*b*, and to seal portions of the opposite lateral ends of the body flange portion 42 to the inside surface of the front wall 16 at interface 50*c*.

As illustrated in FIGS. 1 and 2, access to the fastener assembly 26 from the exterior of the package is preferably provided by the provision of an elongated, frangible region, substantially aligned with fastener assembly 26, and in particular in the region between seal 41 and seal 44. In the illustrated embodiment the frangible region comprises an elongated frangible joint 52 formed through the front wall 16 of the bag body.

The joint 52 is preferably defined by a preferentially weakened frangible portion of the bag front wall 16, such as by perforations 53, which when broken or ripped, result in formation of an elongated opening by which access to fastener assembly 26 is provided. An enlarged perforation 53*a* is preferably located at each end of the joint to prevent further ripping. As shown in FIG. 1, the joint has an arcuate center region 52*c* formed by perforations 53 which, when separated, forms a convenient tab 52*d* for handling by the user to pull apart the remainder of the opening and also thereafter to open the joint 52 of the bag. Perforators 53 in the center region 52*c* could be made longer (i.e., slits) so as to make them easier to grip and open.

According to the present invention a primary peelable seal 48 (shown cross-hatched) is applied between the first body flange portion 40 and the front wall 16, substantially covering the perforations 53 along the line of perforations 52, and beneath the center region 52*c* and vertically up to seal 41 on each side of center region 52*c* so that oxygen is effectively isolated in the space behind tab 52*d*. The tab 52*d* is left unsealed to the body flange portion 40. At the joint, the peelable seal 48 effectively limits oxygen into the bag to that oxygen passing through the perforations 53 and oxygen accumulated behind the unsealed tab 52*d* which then passes through the microstructure of the material of the first body flange portion 40. Depending on the relative vertical position of the perforations 53 with respect to the first body flange portion 40 it may be advantageous to also seal the front wall 16 to the second body flange portion 42 by the primary peelable seal 48.

Depending on the effectiveness of the peelable seal 48 and the relative location of the perforation 53 with regard to the first and second body flange portions sealed to the front wall 16, the peelable seal 47 between the first and second body flange portions may be eliminated.

The primary peelable seal 48 can be applied as a strip of peelable seal material coextruded with either the bag wall or one or both first and second body flange portions 40, 42. The peelable seal 48 can be an intentionally weakened heat seal, or can be formed by an adhesive or by constituents blended into one or both of the front wall 16 or body flange portions and heat activated accordingly. The primary peelable seal 48 can be formed in similar fashion as the secondary peelable seal 47 previously described.

Opening of the joint 52 permits the primary peelable seal 48 to be readily separated. After separation of seal 48, profile strips 28, 30 can be easily separated by disengagement of protuberances 38*a*, 38*b* from grooves 34*a*, 34*b*, thus permitting access to the contents of the packages.

By providing the seal regions 41, 44 closely surrounding the frangible joint 52, a large and rigidifying seal can be avoided and only a thin surrounding seal can be used. Since seal regions 41, 44 are positioned on the same side of the profile strips (i.e., above the strips in the illustrated embodiment) a hermetic seal can be formed with the peelable seal 48 about the access opening (provided by joint 52).

Figure 5:
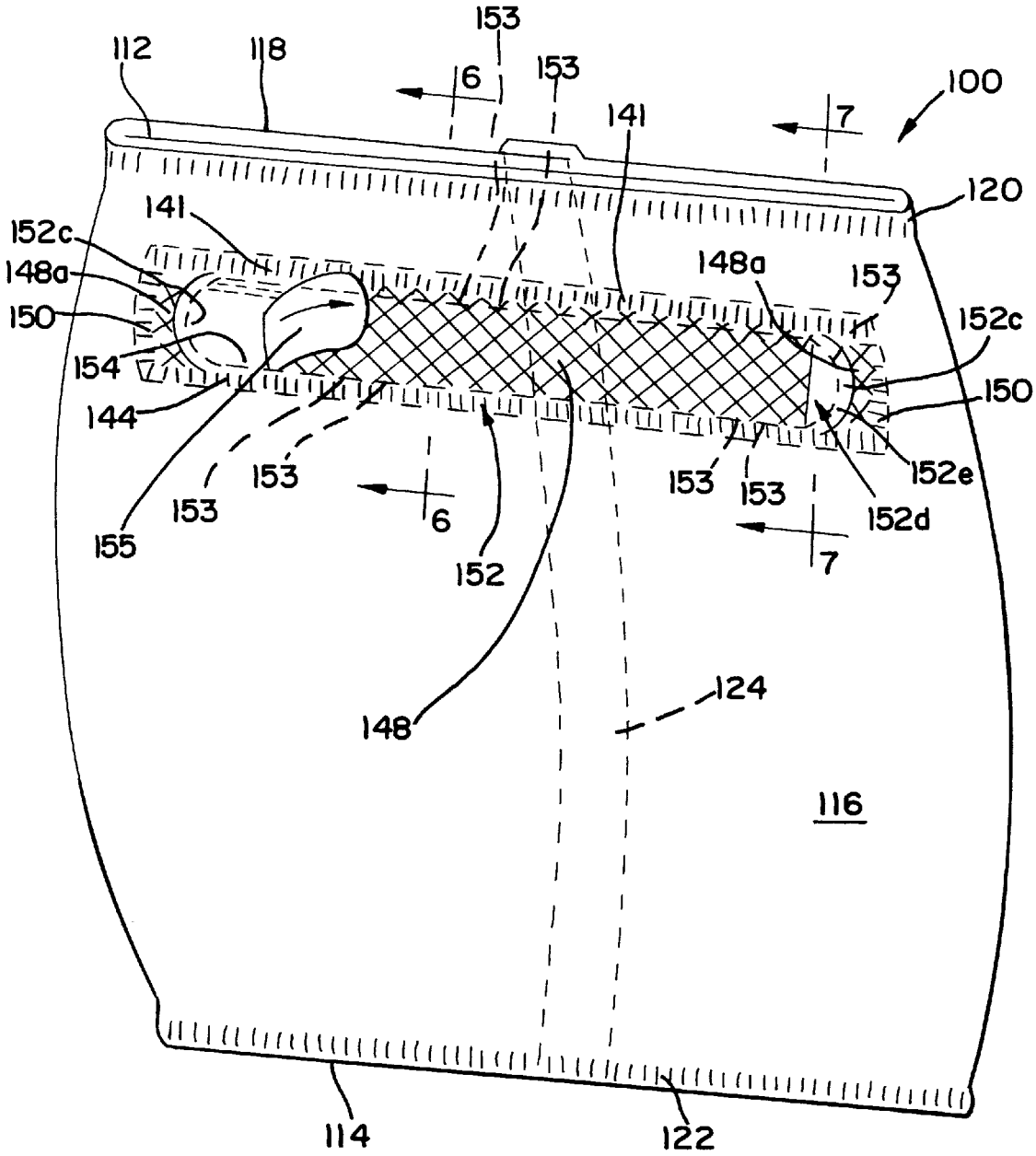
FIG. 5 is a perspective partially cut-away view of an alternate embodiment reclosable bag of the present invention.
Figure 7:
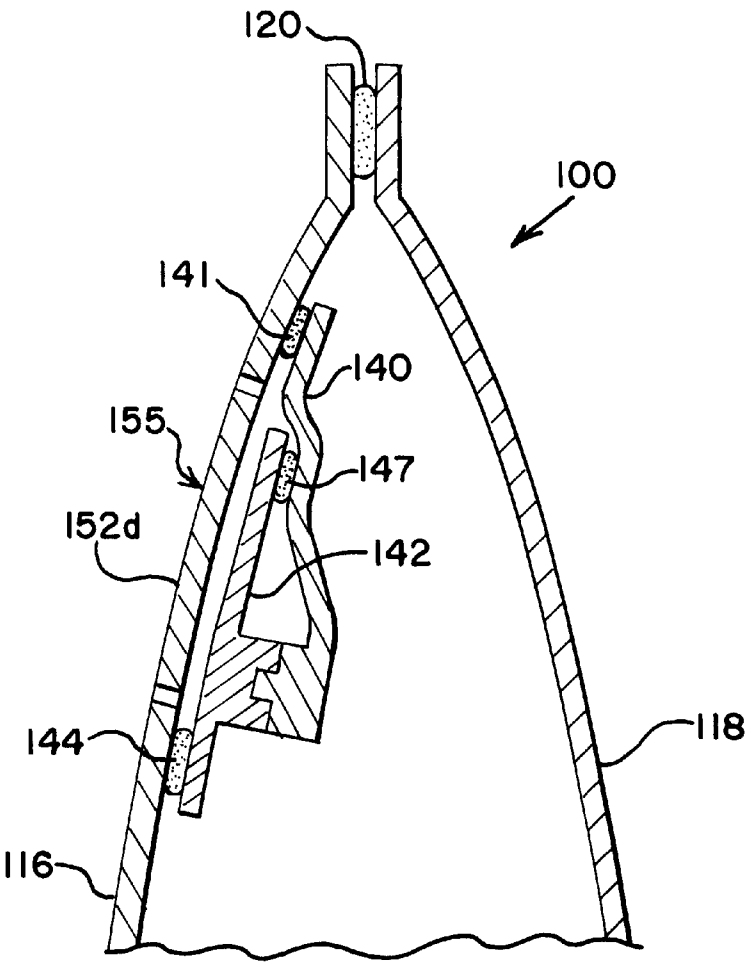
FIG. 7 is a fragmentary cross-sectional view taken along lines 7—7 of FIG. 5.
Figure 6:
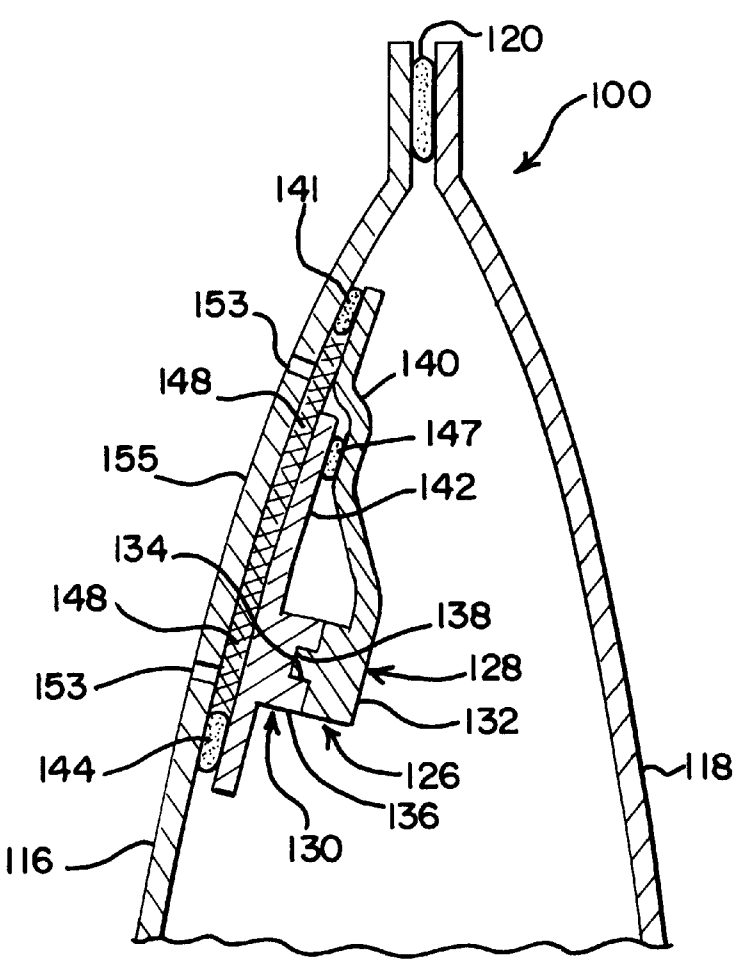
FIG. 6 is a fragmentary cross-sectional view taken along lines 6—6 of FIG. 5.

FIGS. 5–7 illustrate an alternate embodiment of the present invention. A reclosable bag 100 is formed from a generally rectangular sheet of film material, and includes a top end generally designated 112, a bottom end generally designated 114, and front and back walls 116 and 118. The front and back walls are joined to each other by upper and lower seams 120, 122 (shown schematically as tracks), respectively provided at top and bottom ends 112 and 114 of the bag. Lateral edges of the rectangular sheet of film material from which the bag body is formed are joined to each other along a back seam 124 extending vertically along back wall 118. The seams 120, 122, and 124 can be formed adhesively, or by heat-sealing as is known in the art. As will be appreciated, a bag configured in accordance with the present invention can be formed from two rectangular sheets of bag material joined at their peripheral regions to form a package, with the fastener assembly having a length corresponding to the width of the sheet of bag material to which the fastener assembly is joined.

Reclosable bag 100 includes profile strip fastener assembly 126 which is sealingly mounted on the inside surface of front wall 116.

The fastener assembly 126 includes a first elongated profile strip 128, and a second elongated profile strip 130 which are configured for releasable interlocking engagement with each other. While the specific configuration of the profile strips can be varied while keeping with the principles disclosed herein, it is contemplated that one of the profile strips (first strip 128 in the illustrated embodiment) includes a body 132 which defines at least one protuberance 134, while the other profile strip (second strip 130) includes a body 136 which defines at least one groove 138 configured for respective interlocking engagement with the protuberance 134. As will be recognized by those familiar with the art, the number of grooves and protuberances, and their respective disposition on the first and second profile strips, can be varied while keeping with the principles disclosed herein.

The fastener assembly 126 is sealingly mounted on the inside surface of the front wall 116 of the body of the reclosable bag 110, and to this end, each of the profile strips 128, 130, includes an elongated flange portion joined to the inside surface of the front wall. Specifically, first profile strip 128 includes a first body flange portion 140 which is joined to the inside surface of front wall 116 by elongated seal region 141 (shown schematically as tracks). Similarly, second profile strip 130 includes a second body flange portion 142 (including upper and lower flange regions which respectively extend upwardly and downwardly from the body 136) which is joined to the inside surface of front wall 116 by lower elongated seal region 144 (shown schematically as tracks). Elongated seal regions 141, 144 may be arranged in the form of an continuous oval seal including end seal regions 150 (shown schematically as tracks) described below. It is within the purview of the present invention that seal regions 141, 144, 150 may be formed with the use of suitable adhesive, but are preferably provided by heat-sealing (sometimes referred to as "lock-up" or "destruct" sealing). The seals 141, 144, 150 are preferably continuous for strength and for sealing of the contents of the bags, but discontinuous seals may be suitable for some applications.

The flange portions and the bodies of the first and second profile strips 128, 130 can be composed of similar materials and constructed as described for the previous embodiment.

The profile strips are sealed at opposite ends in similar fashion as described in the previous embodiment. The end seals 150 can be substantially identical to the configuration of the end seals 50 shown in FIG. 4. That is, the body flange portions 140, 142 are sealed to each other and each to the front wall 116 vertically between the seals 141, 144. The bodies 132, 136 can be compressed and sealed together as shown in FIG. 4 with regard to the bodies 32, 36.

The fastener assembly embodying the principles of the present invention can include a secondary, peelable seal 147 which detachably joins the profile strips to each other, apart from the releasable engagement of protuberances 134 in the grooves 138.

As will be appreciated, the secondary peelable seal 147 preferably is configured to extend substantially the entire length of the fastener assembly 126, thus desirably acting to provide an additional seal for the contents of the bag 100 in addition to the seal provided by interlocked portions 134, 138 of the profile strips 128, 130. Further sealing of the contents of the bag against air and moisture transmission is preferably effected by the provision of the end seals 150 at respective opposite lateral ends of the fastener assembly 126.

As illustrated in FIGS. 5 and 6, access to the fastener assembly 126 from the exterior of the package is preferably provided by the provision of an elongated, frangible region, substantially aligned with fastener assembly 126, and in particular in the region between seal 141 and seal 144. In the illustrated embodiment the frangible region comprises an elongated substantially rectangular or oval frangible joint 152 formed through the front wall 116 of the bag body.

The joint 152 is preferably defined by a preferentially weakened frangible portion of the bag front wall 116, such as by perforations 153, which when broken or ripped, result in formation of an elongated opening 154 by which access to fastener assembly 126 is provided. As shown in FIG. 5, the joint has arcuate end regions 152*c* which, when separated, form convenient tabs 152*d* for handling by the user to pull apart the remainder of the opening 154. Alternatively, a single tab 152*d* can be provided at only one end of the joint 152. The joint 152 defmes a removable panel 155 which, once removed, provides access to the profile strip assembly 126 as well as serving as tamper-indication.

According to the present invention a primary peelable seal 148 (shown cross-hatched) is applied between the first body flange portion 140 and the front wall 116, and between the second body flange portion 142 and the front wall 116, substantially covering the perforations 153 along the line of perforations 152, and up to the end regions 152*c* and covering the removable panel 155. It is not necessary to cover the entire removable panel 155 with the peelable seal 148, it is acceptable to cover only the perforations 153 which, in part, define the removable panel. The tab(s) 152*d* is (are) left unsealed. This includes an outer band 152*e* which is located on an outside of the end regions 152*c*. A peelable seal band 148*a* can also be arranged between the outer band 152*c* and the end seal 150. Where only one tab 152*d* is used, the respective other arcuate end region 152*c* would be completely sealed by the peelable seal 148. Using only one tab 152*d* also minimizes oxygen entry through the joint 152. The peelable seal 148 effectively limits oxygen passing into the bag at the joint to that oxygen passing through the perforations, and oxygen accumulated behind the tab(s) 152*d*, which passes through the microstructure of the material of the first and second body flange portions 140, 142.

Depending on the effectiveness of the primary peelable seal 148 and the relative location of the perforation 153 with regard to the first and second body flange portions sealed to the front wall 116, the secondary peelable seal 147 between the first and second body flange portions may be eliminated. The peelable seals 147, 148 can be formed and applied as described in the previous embodiment.

Opening of the joint 152 and removal of the panel 155 permits opening of profile strips 128, 130, thus permitting access to the contents of the package.

The present invention also contemplates using antioxidants blended with profile extruded polymeric materials such as is used to make flexible interlocking fastener strips. The preferred naturally occurring (food-grade) antioxidant for use with extruded polymeric materials such as polyethylene, polypropylene, or the like is BHT. BHT is preferred since it is more heat stable than other forms of antioxidants which is especially important since the process temperatures required to extrude such polymeric materials are in excess of 245 degrees F. which is the flash point of BHT. Therefore even when using BHT a substantial amount of antioxidant is flashed off or wasted during the extrusion process. This flashing off of antioxidant also creates difficulties in determining what level of antioxidant to blend into the polymeric resin master batch when a concentration level of 0.1 to 0.16% is preferred in the finished profile assembly.

The preferred embodiment of the fastener strip assembly of the present invention is one that has two profile strips that interlock and at least one of the profile strips has a flange extending from its interlocking body for use in attaching it to a packaging substrate. The profile strip assembly is made from a blend of polymeric materials and a naturally occurring food-grade antioxidant such as BHT. The concentration level of BHT is greater than the amount that might be included only for the purpose of stabilizing the polymers during the extrusion process by preventing heat degradation such as cross-linking due to oxidation. The concentration of BHT in the fastener assembly can be any amount that will process efficiently and remains within any FDA guide lines that may be relevant for packaging certain products. In the case of cereals the stabilized packaged cereal must not contain more than 50 parts per million by weight of cereal.

The amount of food-grade antioxidant required to be in the fastener assembly will vary depending on how much antioxidant the stored product/package contains, which will depend on the particular product type and the shelf life requirements. The fastener assembly including a relatively high level of food-grade antioxidants has the unique ability to increase the shelf life of the stored product within a package formed using the fastener, since the antioxidant can terminate auto-oxidation by forming phenoxy radicals as oxygen scavengers in and around and within the fastener.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover by the appended claims all such modifications as fall within the scope of the claims.

What is claimed is:

1. A bag, comprising:

a bag body formed from a rectangular sheet of film material, said bag body having a top end, a bottom end, a front wall, and a back wall, said front wall being joined to said back wall by upper and lower seams respectively provided at said top and bottom ends; and a reclosable fastener assembly joined to said front wall and comprising first and second interlocking profile strips respectively extending along the length of the fastener assembly, said profile strips being configured for releasable interlocking engagement with each other by the provision of at least one protuberance on one of said profile strips, and at least one groove defined by the other of said profile strips for respectively releasably receiving said protuberance, said first profile strip including a body flange portion joined at a first seal to an inside surface of said front wall of said bag body, and said second profile strip including a second body flange portion joined at a second seal to the inside surface of said front wall of said bag body, said front wall including an openable joint between said first and second seals, said first and second seals formed around said joint; and a peelable seal formed between said first body flange portion and said front wall substantially sealing at least a portion of said joint against said first body flange portion, said portion of said joint including perforations, said perforations of said front wall located within said peelable seal.

2. The bag according to claim 1, wherein one of said first and second profile strips is composed of a material having an antioxidant constituent, said antioxidant constituent being sufficient to form phenoxy radicals as oxygen scavengers in and around said fastener assembly.

3. A bag according to claim 2, wherein said one of said first and second profile strips has an antioxidant constituent concentration level greater than about 0.1%.

4. A bag according to claim 2, wherein said antioxidant constituent includes one antioxidant compound selected from the group consisting of BHT, BHA, TBHQ, and PG.

5. The bag according to claim 1, wherein said fastener assembly includes a second peelable seal formed between and joining said first and second body flange portions, so that said second peelable seal must be opened to provide access to an opening between said first and second profile strips when they are released from interlocking engagement with each other.

6. The bag according to claim 1, wherein said joint includes elongate, frangible access means formed into said front wall of said bag body and substantially aligned with said fastener assembly.

7. The bag according to claim 1, including:

a pair of end seals at respective opposite ends of said fastener assembly for joining respective ends of said profile strips to each other.

8. The bag according to claim 1, wherein said openable joint is configured in a substantially elongated rectangular shape defining a removable panel, and said peelable seal is formed between said second body flange portion and said front wall, substantially sealing at least a second portion of said joint against said second body flange portion.

9. The bag according to claim 1, wherein said entire length of said joint is sealed by said peelable seal to at least one of said first and second body flange portions except for a tab-defining-portion of said joint.

10. A bag, comprising:

a bag body formed from a rectangular sheet of film material, said bag body having a top end, a bottom end, a front wall, and a back wall, said front wall being joined to said back wall by upper and lower seams respectively provided at said top and bottom ends; and a reclosable fastener assembly joined to said front wall and comprising first and second interlocking profile strips respectively extending along the length of the fastener assembly, said profile strips being configured for releasable interlocking engagement with each other by the provision of at least one protuberance on one of said profile strips, and at least one groove defined by the other of said profile strips for respectively releasably receiving said protuberance, said first profile strip including a body flange portion joined at a first seal to an inside surface of said front wall of said bag body, and said second profile strip including a second body flange portion joined at a second seal to the inside surface of said front wall of said bag body, said front wall including an openable joint between said first and second seals, said first and second seals formed around said joint; and a peelable seal formed between said first body flange portion and said front wall substantially sealing at least a portion of said joint against said first body flange portion;

wherever one of said, first and second profile strips is composed of a material having an antioxidant constituent;

wherein said antioxidant constituent is butylated hydroxy toluene, said antioxidant constituent sufficient in concentration to increase the shelf life of a product contained within the bag body.

11. A reclosable bag, comprising a bag body formed from at least one rectangular sheet of film material, said bag body having a top end, a bottom end, a front wall, and a back wall, said front wall being joined to said back wall by upper and lower seams respectively provided at said top and bottom ends; and a reclosable fastener assembly joined to an inside surface of said front wall and comprising first and second interlocking profile strips respectively extending along the length of the fastener assembly, said profile strips being configured for releasable interlocking engagement with each other, and defining an openable bag access;

at least one of said first and second profile strips containing an antioxidant for reacting with oxygen that passes said first and second profile strips;

wherein each of said profile strips includes a body formed from polyethylene, and a body flange portion being formed from material which exhibits relatively low oxygen transmission;

wherein said material from which said body flange portions are formed is selected from the group consisting of nylon and ethylene vinyl alcohol.

12. A reclosable bag, comprising a bag body formed from at least one rectangular sheet of film material, said bag body having a top end, a bottom end, a front wall, and a back wall, said front wall being joined to said back wall by upper and lower seams respectively provided at said top and bottom ends; and a reclosable fastener assembly joined to an inside surface of said front wall and comprising first and second interlocking profile strips respectively extending along the length of the fastener assembly, said profile strips being configured for releasable interlocking engagement with each other, and defining an openable bag access, at least one of said first and second profile strips containing an antioxidant for reacting with oxygen that passes said first and second profile strips;

wherein said antioxidant includes butylated hydroxy toluene.

13. A bag, comprising:

a bag body formed from a rectangular sheet of film material, said bag body having a top end, a bottom end, a front wall, and a back wall, said front wall being joined to said back wall by upper and lower seams respectively provided at said top and bottom ends; and a reclosable fastener assembly joined to said front wall and comprising first and second interlocking profile strips respectively extending along the length of the fastener assembly, said profile strips being configured for releasable interlocking engagement with each other by the provision of at least one protuberance on one of said profile strips, and at least one groove defined by the other of said profile strips for respectively releasably receiving said protuberance, said first profile strip including a body flange portion joined at a first seal to said bag body, and said second profile strip including a second body flange portion joined at a second seal to the inside surface of said front wall of said bag body, said front wall including an openable joint between said first and second seals, said first and second seals formed around said joint; and a peelable seal formed between said first body flange portion and said front wall substantially sealing at least a portion of said joint against said first body flange portion, said portion of said joint including perforations, said perforations of said front wall located within said peelable seal.

* * * * *